US007008332B2

(12) United States Patent
Liou

(10) Patent No.: US 7,008,332 B2
(45) Date of Patent: Mar. 7, 2006

(54) GOLF CLUB HEAD WITH COMPOSITE TITANIUM-GRAPHITE HEAD

(75) Inventor: Jethro Liou, Industry, CA (US)

(73) Assignee: Trophy Sports, Inc., City of Industry, CA (US)

( * ) Notice: Subject to any disclaimer, the term of this patent is extended or adjusted under 35 U.S.C. 154(b) by 0 days.

(21) Appl. No.: 10/766,220

(22) Filed: Jan. 28, 2004

(65) Prior Publication Data

US 2005/0164807 A1 Jul. 28, 2005

(51) Int. Cl.
*A63B 53/04* (2006.01)

(52) U.S. Cl. ..... 473/345; 473/346; 473/349

(58) Field of Classification Search ..... 473/324–350
See application file for complete search history.

(56) References Cited

U.S. PATENT DOCUMENTS

| | | | | |
|---|---|---|---|---|
| 4,021,047 | A * | 5/1977 | Mader | 473/345 |
| 5,205,560 | A * | 4/1993 | Hoshi et al. | 473/345 |
| 5,624,331 | A * | 4/1997 | Lo et al. | 473/345 |
| 5,776,011 | A * | 7/1998 | Su et al. | 473/345 |
| 5,997,415 | A * | 12/1999 | Wood | 473/346 |
| 6,183,377 | B1 * | 2/2001 | Liang | 473/324 |
| 6,645,086 | B1 * | 11/2003 | Chen | 473/335 |
| 2001/0049310 | A1 * | 12/2001 | Cheng et al. | 473/334 |
| 2002/0169034 | A1 * | 11/2002 | Hocknell et al. | 473/329 |
| 2003/0083151 | A1 * | 5/2003 | Nakahara et al. | 473/345 |
| 2003/0125127 | A1 * | 7/2003 | Nakahara et al. | 473/329 |
| 2003/0134692 | A1 * | 7/2003 | Nakahara et al. | 473/345 |
| 2003/0134693 | A1 * | 7/2003 | Nakahara et al. | 473/345 |
| 2003/0162608 | A1 * | 8/2003 | Chen | 473/345 |
| 2004/0005936 | A1 * | 1/2004 | Imamoto et al. | 473/344 |
| 2004/0053705 | A1 * | 3/2004 | Kumamoto | 473/345 |
| 2004/0116207 | A1 * | 6/2004 | De Shiell et al. | 473/345 |
| 2004/0116208 | A1 * | 6/2004 | De Shiell et al. | 473/345 |
| 2004/0192468 | A1 * | 9/2004 | Onoda | |
| 2005/0096154 | A1 * | 5/2005 | Chen | 473/345 |
| 2005/0119068 | A1 * | 6/2005 | Onoda et al. | 473/342 |
| 2005/0159243 | A1 * | 7/2005 | Chuang | 473/345 |

FOREIGN PATENT DOCUMENTS

WO WO 03/064139 A1 * 7/2003

* cited by examiner

*Primary Examiner*—Sebastiano Passaniti
(74) *Attorney, Agent, or Firm*—Squire, Sanders & Dempsey L.L.P.

(57) ABSTRACT

A metal wood golf club head having a metallic assembly including an opening in at least a top plate and a composite cover bonded to the metallic assembly to cover the opening.

12 Claims, 4 Drawing Sheets

FIG. 2
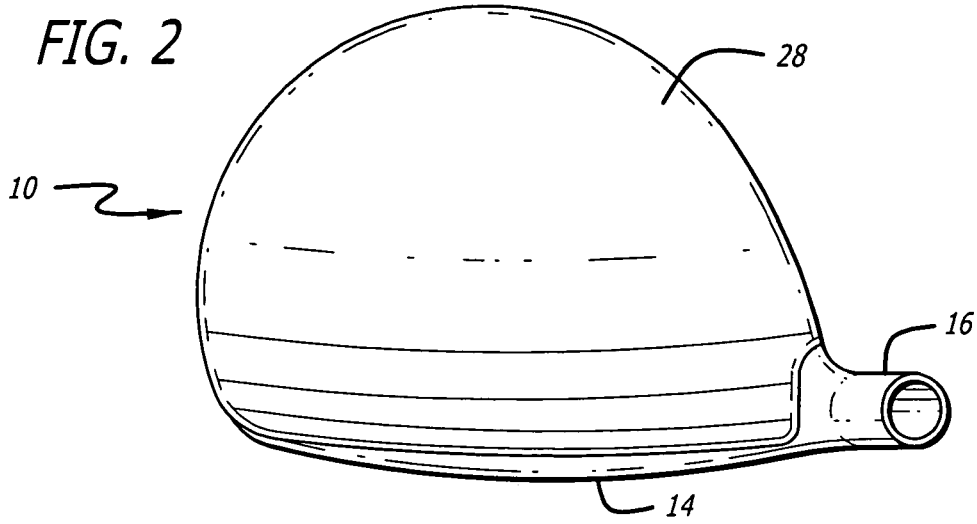
FIG. 3
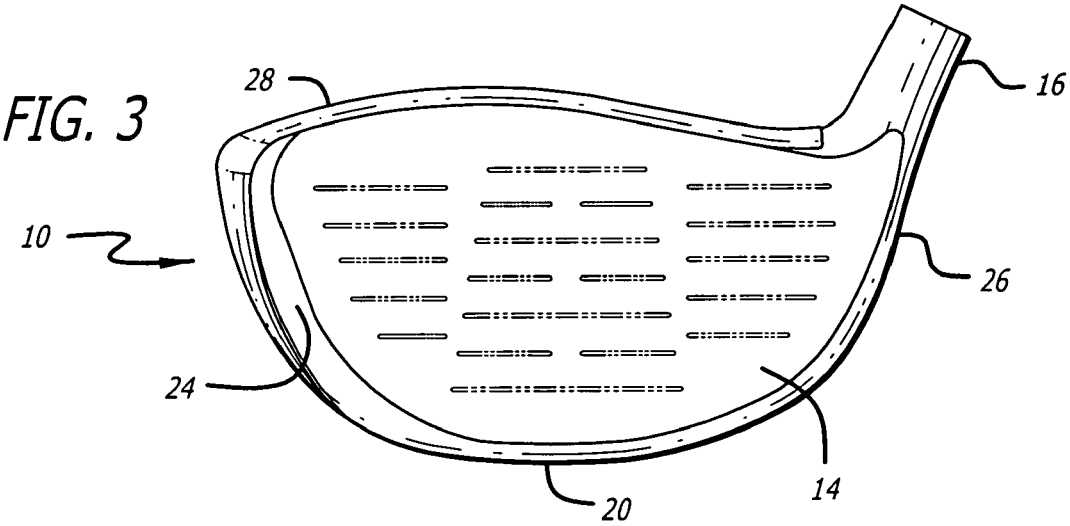
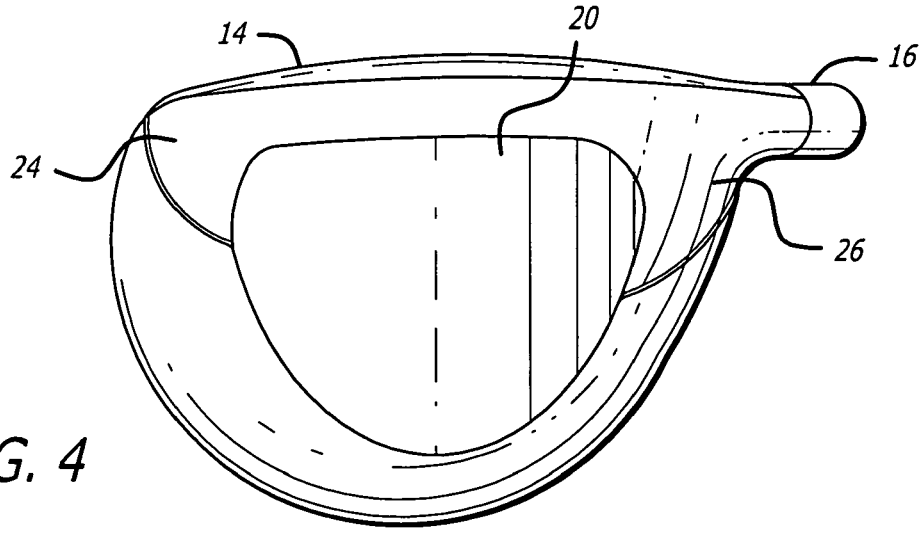
FIG. 4

GOLF CLUB HEAD WITH COMPOSITE TITANIUM-GRAPHITE HEAD

BACKGROUND OF THE INVENTION

1. Field of the Invention

This invention relates generally to a metal "wood" golf club head, and more particularly, to a metal "wood" golf club head having a metal component and a graphite component bonded together to form a composite club head.

2. Description of the Related Art

Golf club manufacturers have made new and different designs for golf clubs to improve a golfer's performance. Different materials including metals for the "woods" have been used to increase ball flight distance and improve the feel of the club. Various weighting schemes, including perimeter weighting, have been proposed to optimize the center of gravity and moment of inertia of club heads. Oversized club heads have been utilized to attempt to provide a large sweet spot on the ball striking face. However, the weight of golf clubs that can be used in professional events is strictly controlled by golf associations. Accordingly, particularly for the oversized club heads, weight or metal thickness in or around the faceplate may be sacrificed to allow adequate thickness throughout the entirety of the oversized head.

Perhaps the most important factor in hitting a golf ball well is the location of impact of the ball on the striking surface of the faceplate. A ball which is hit in the center of the sweet spot will generally go farther and straighter than a ball impacting near the heel or toe of the faceplate. The weight or mass distribution in or at the periphery of the faceplate becomes increasingly significant for hitting golf balls at a location moving away from the sweet spot. Thus, club designers seek to maximize efficiency of both on target strikes within the sweet spot and off target strikes outside of the sweet spot.

BRIEF SUMMARY OF THE INVENTION

The present invention provides a method of fabricating a composite metal/graphite "wood" golf club head. The faceplate, sole plate hosel, toe portion, heel portion and portions of the top plate and rear wall are formed from metal such as titanium. A graphite cover is shaped to conform precisely to the top, toe portion, rear wall and most of the heel portion of the club head so as to be bonded to the metal portion thereof.

By eliminating the metal from a significant section of the top plate and rear wall of the metal portion and utilizing the lighter weight graphite cover to maintain strength and aerodynamics, additional mass may be moved to the faceplate, the periphery of the faceplate and to the soleplate, to improve performance of the club head.

The above described and many other features and attendant advantages of the present invention will become apparent from a consideration of the following detailed description in conjunction with the accompanying drawings.

BRIEF DESCRIPTION OF THE DRAWINGS

A detailed description of the invention will be made with reference to the accompanying drawings wherein:

FIG. 2 is a top view of the golf club head of the present invention;

FIG. 3 is a view of the front of the faceplate of the golf club head of FIG. 1;

FIG. 4 is a view of the bottom of the golf club head of FIG. 1;

DETAILED DESCRIPTION OF THE PREFERRED EMBODIMENTS

Figure 1:
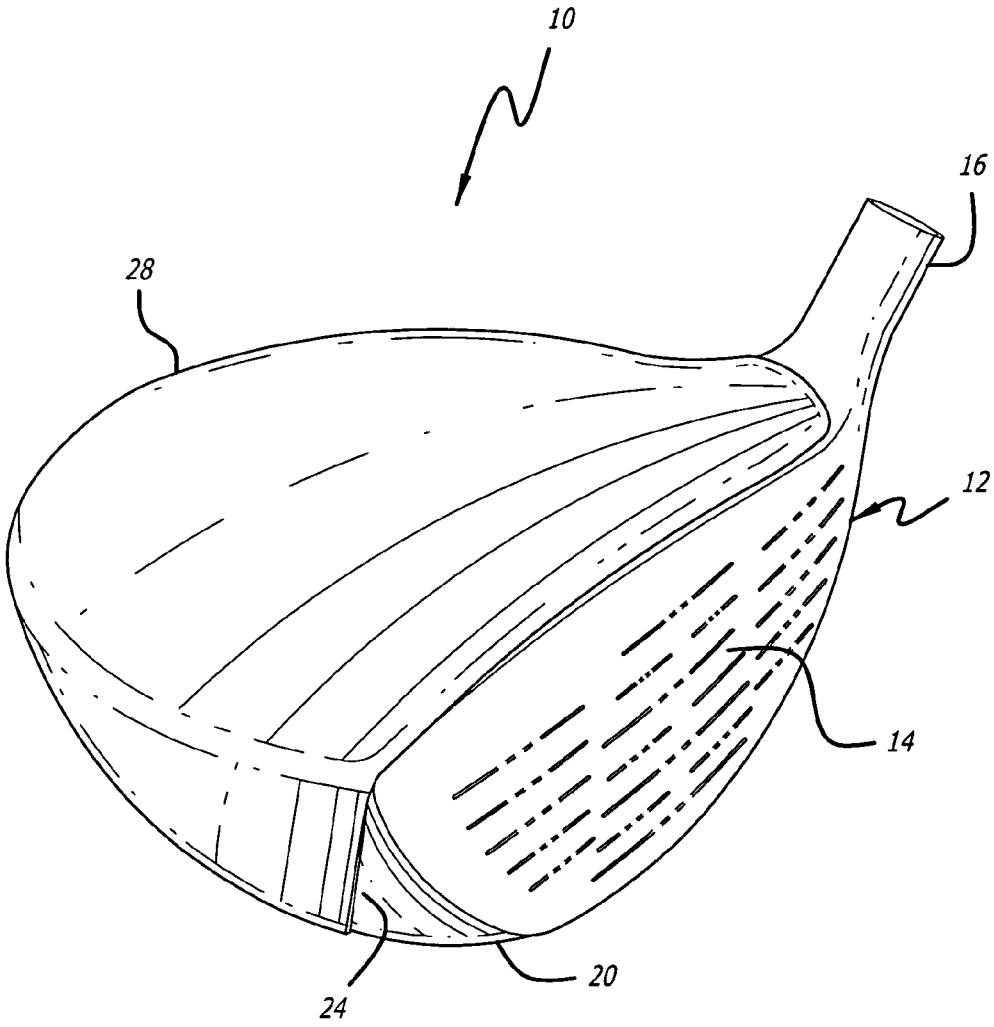
FIG. 1 is a perspective view of the golf club head of the present invention.

FIGS. 1–5 show a composite golf club head 10 in accordance with the present invention. The golf club head 10 includes a metallic portion 12 that includes a faceplate 14, a hosel 16; a top plate 18 and a sole plate 20. The sole plate 20 may include a rear portion 22, toe portion 24 and a heel portion 26, although these portions could also be formed as part of the top plate 18. In addition to the metallic portion 12, the club head 10 includes a composite cover 28, designed so as to fit snugly over and conform to the top plate 18, and the rear portion 22, toe portion 24 and much of the heel portion 26 of the sole plate. The composite cover 28 is bonded to the metallic portion 12 using an appropriate bonding material, such as a glue, epoxy or solvent based adherent.

The hosel 16 is positioned in the hollow interior of the golf club head at the joint between the heel portion 26 of the sole plate 20 and the faceplate 14 and is formed and placed in the club head 10 to receive a golf club shaft. The hosel 16 is preferably aligned with or offset from the center of gravity of the club head 10. The club head 10 depicted is for a right handed user, while a club head for a left handed user would have a mirror image construction.

The materials used to form the metal portion 12 of the club head 10 include steel, stainless steel, titanium, and other metallic materials having similar or enhanced strength and resilience properties, however titanium is preferred.

The golf club head 10 of the present invention is made by forging or casting each of the faceplate 14, top plate 18 and sole plate 20. The hosel 16 is either cast, rolled or cut from a tube. The faceplate 14 may also be milled to for a preferred pattern or differential thickness pattern.

To assemble the club head 10, faceplate 14 is attached to the sole plate 20 by welding. The hosel 16 is then attached to the faceplate 14 and to the sole plate 12 by spot welding. Next, the top plate 18 is welded to a top edge of the faceplate 14 as well as to the top edges of the rear portion 22, toe portion 24, and heel portion 26 of the soleplate 20. To finish the metallic portion 12 of the club head, a mill or grinding wheel is used to mill or grind off welds on the outside of the metallic portion 12.

Figure 5:
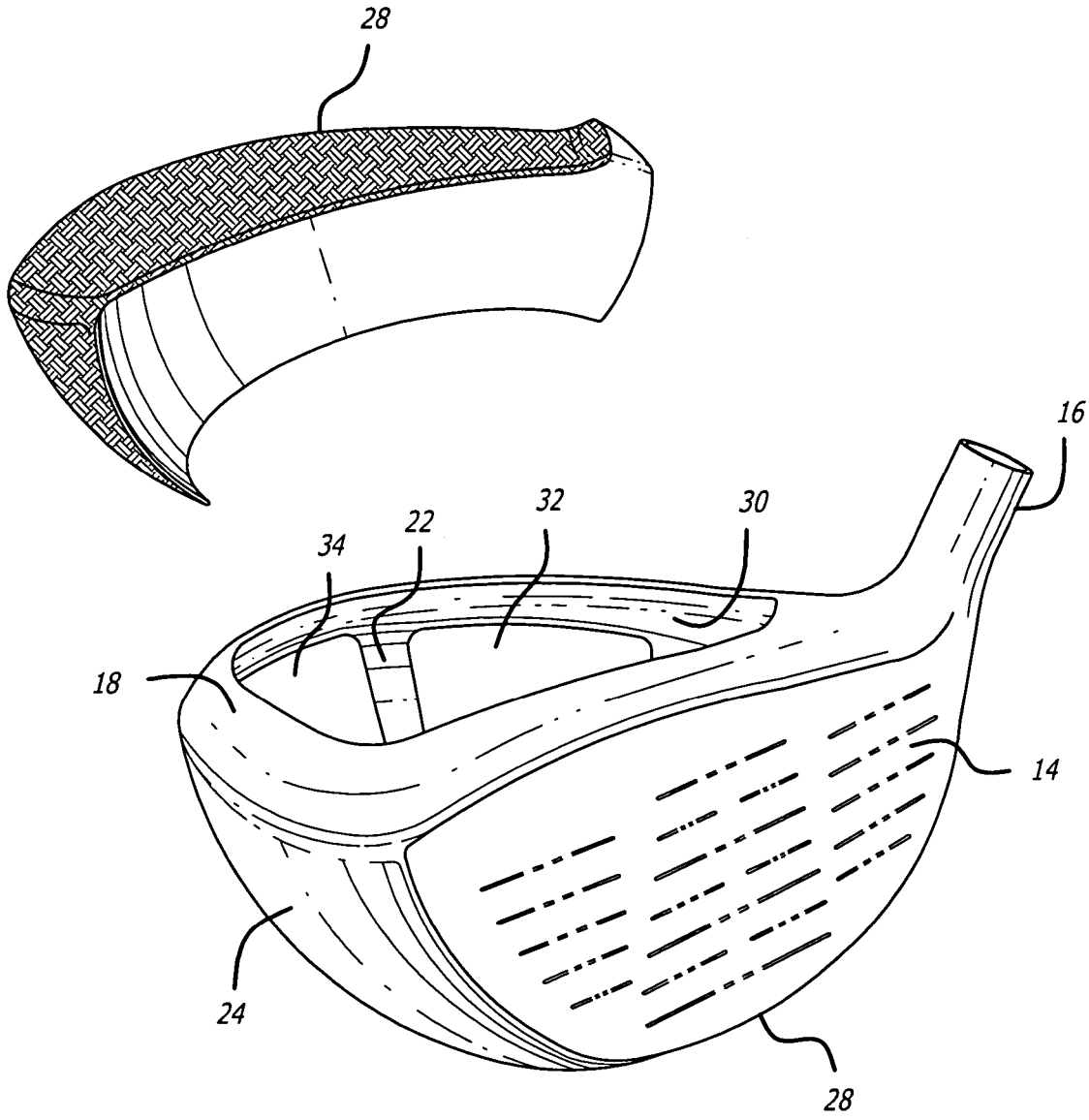
FIG. 5 is an exploded perspective view of the components of the golf club head according to the present invention.

As illustrated in FIG. 5, the top plate 18 preferably includes an opening 30. In addition, the rear portion 22 of the sole plate 20 includes openings 32 and 34. The openings 30, 32 and 34 may be formed prior to attachment of the top 18 to the rear portion 22 to the remaining components. Alternatively, the top 18 and rear portion 20 may be milled or cut after the assembly of the metallic portion 12.

In a separate process, the cover 28, as illustrated in FIG. 5, is formed on a mold (not shown) having a shape precisely matching the shape of the corresponding portions of the metal portion 12 of the club head 10. The cover 28 is preferably formed from a woven graphite mesh bonded within an epoxy. After the cover 28 is formed and the epoxy hardens, the cover 28 is removed from the mold and bonded to the top 18, rear portion 22, toe portion 24 and heal portion 26 of the sole plate, thereby covering the openings 30, 32 and 34. The cover 28 has structural characteristics exceeding those of equal thickness metal components while reducing the weight as compared to a fully enclosed metallic portion 12 having no openings. As a result, the overall strength of the club head 10 is improved while the weight allocated to the top and rear portions is decreased, to be distributed as deemed appropriate to the face plate, periphery of the faceplate or the base of the sole plate.

Figure 6:
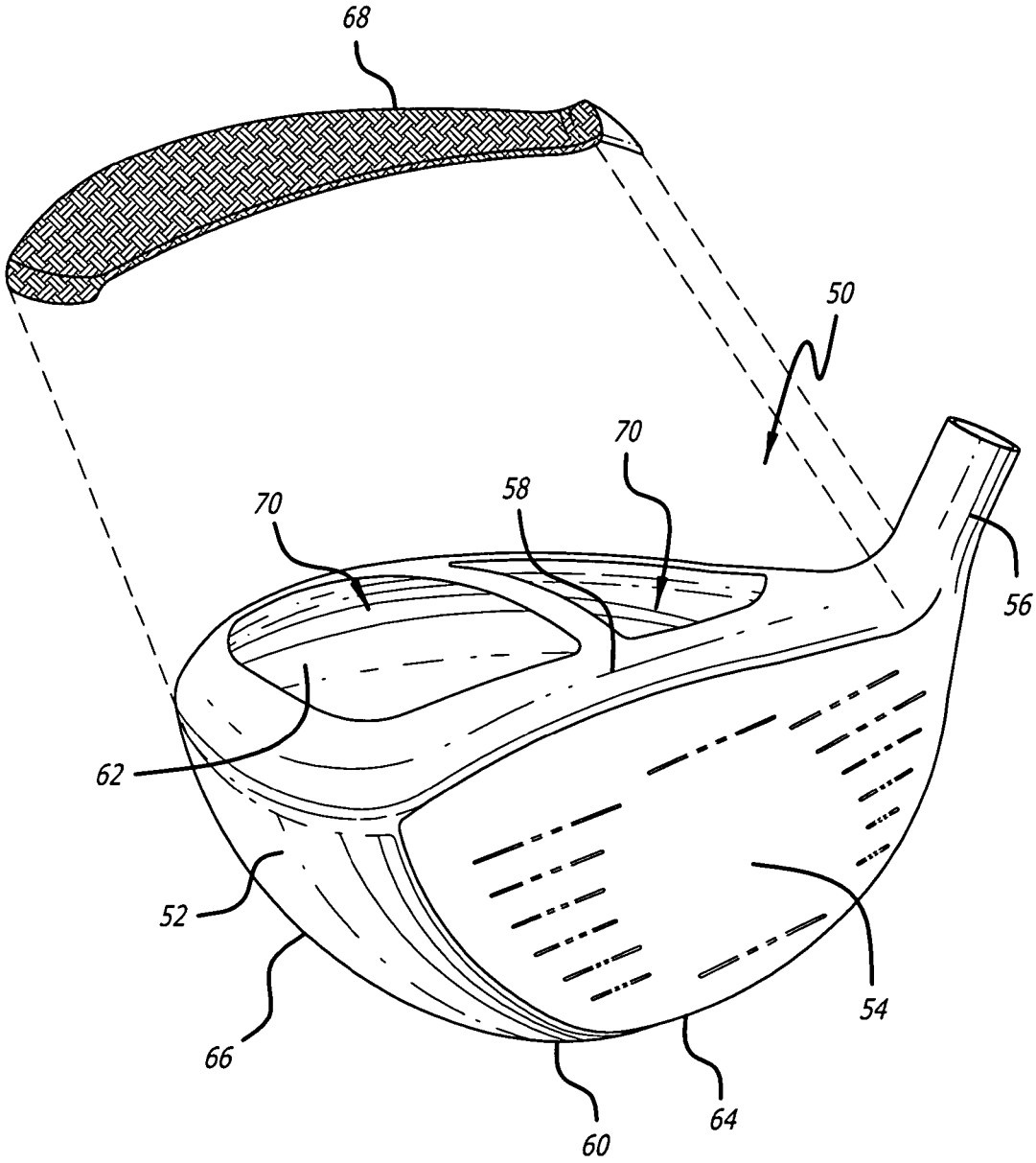
FIG. 6 is an exploded perspective view of an alternative embodiment of the golf club head according to the present invention.

FIG. 6 depicts an exploded view of an alternative design of a golf club head 50 according to the invention. The golf club head 50 includes a metallic portion 52 that includes a faceplate 54, a hosel 56; a top plate 58 and a sole plate 60. The sole plate 60 may include a rear portion 62, toe portion 64 and a heel portion 66, although these portions could also be formed as part of the top plate 58. In addition to the metallic portion 52, the club head 50 includes a composite cover 68, designed so as to fit snugly over and conform to the upper side of the top plate 58. The composite cover 68 is bonded to the metallic portion 52 using an appropriate bonding material, such as a glue, epoxy or solvent based adherent, as discussed above. Also as discussed above and as illustrated in FIG. 6, the upper side of the top plate 58 includes at least one opening 70 that is covered by the composite cover 68. The composite cover is formed on a mold by the combination of a woven graphite mesh and an epoxy, as discussed above with respect to the composite cover 28, prior to being bonded to the top plate 58.

Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A golf club head formed by the method comprising:

forming a metallic assembly including a sole plate, a faceplate, a top plate, and a hosel, said metallic assembly including at least one opening formed in said top plate and at least one opening formed in a rear portion of said sole plate, said top plate being continuously and directly connected to said rear portion of said sole plate;

forming a composite cover to fit over said top plate and said sole plate to cover metallic portions of said top plate and said rear portion of said sole plate as well as to cover said at least one opening in said top plate and said at least one opening in said rear portion of said sole plate; and bonding said composite cover to said metallic assembly.

2. The golf club head of claim 1 wherein said metallic assembly includes at least two openings formed in said top plate and two openings formed in a rear portion of said sole plate.

3. The golf club head of claim 1 wherein said composite cover is formed from a woven graphite mesh bonded with an epoxy.

4. The golf club head of claim 1 wherein said faceplate is welded to said sole plate, said hosel is welded to said sole plate and faceplate and said top plate is welded to said sole plate, faceplate and hosel.

5. The golf club head of claim 1 wherein said metallic assembly is formed from a material selected from the group consisting of steel, stainless steel, titanium, and other steel alloy materials.

6. The golf club head of claim 1 wherein at least one of said sole plate, said faceplate and said top plate are formed from a material selected from the group consisting of steel, stainless steel, titanium, and other steel alloy materials.

7. A golf club head comprising:

a metallic assembly including a sole plate, a faceplate, a top plate, and a hosel, said metallic assembly including at least one opening formed in said top plate and at least one opening formed in a rear portion of said sole plate, said top plate being continuously and directly connected to said rear portion of said sole plate; and a composite cover formed to fit over said top plate and said sole plate to cover metallic portions of said top plate and said rear portion of said sole plate as well as said openings therein, said composite cover bonded to said metallic assembly by a bonding agent.

8. The golf club head of claim 7 wherein said metallic assembly includes an opening formed in said top plate and two openings formed in a rear portion of said sole plate.

9. The golf club head of claim 7 wherein said composite cover is formed from a woven graphite mesh bonded with an epoxy.

10. The golf club head of claim 7 wherein said metallic assembly is formed from a material selected from the group consisting of steel, stainless steel, titanium, and other steel alloy materials.

11. The golf club head of claim 9 wherein said metallic assembly is formed from a material selected from the group consisting of steel, stainless steel, titanium, and other steel alloy materials.

12. A golf club head comprising:

a metallic assembly including a sole plate, a face plate, a top plate, and a hosel, the metallic assembly including at least one opening in the top plate and at least one opening in an upward extending portion of the sole plate, the metallic assembly formed from a material selected from the group consisting of steel, stainless steel, titanium, and other steel alloy materials, said top plate being continuously and directly connected to said upward extending portion of said sole plate; and a composite cover formed from a woven graphite mesh bonded with an epoxy, the composite cover substantially covering metallic portions of said top plate as well as the at least one opening of the top plate and the upward extending portion of the sole plate, the composite cover bonded to the metallic assembly by a bonding agent.

* * * * *